US007174119B2

(12) United States Patent
Sakemi

(10) Patent No.: US 7,174,119 B2
(45) Date of Patent: Feb. 6, 2007

(54) DEVELOPING DEVICE FEATURING HIGH VISCOSITY DEVELOPING AGENT AND SUPERIMPOSED AC AND DC BIAS VOLTAGE COMPONENTS

(75) Inventor: Yuji Sakemi, Ibaragi (JP)

(73) Assignee: Canon Kabushiki Kaisha, Tokyo (JP)

( * ) Notice: Subject to any disclaimer, the term of this patent is extended or adjusted under 35 U.S.C. 154(b) by 268 days.

(21) Appl. No.: 10/753,375

(22) Filed: Jan. 9, 2004

(65) Prior Publication Data

US 2004/0141773 A1 Jul. 22, 2004

(30) Foreign Application Priority Data

Jan. 22, 2003 (JP) ..... 2003-014001

(51) Int. Cl.
*G03G 15/10* (2006.01)

(52) U.S. Cl. ..... 399/240; 399/237

(58) Field of Classification Search ..... 399/240, 399/237, 238, 239
See application file for complete search history.

(56) References Cited

U.S. PATENT DOCUMENTS

| | | | | |
|---|---|---|---|---|
| 4,444,864 | A * | 4/1984 | Takahashi | 430/120 |
| 4,777,107 | A | 10/1988 | Kurematsu et al. | 130/122 |
| 4,844,008 | A | 7/1989 | Sakemi et al. | 118/658 |
| 5,669,050 | A | 9/1997 | Sakemi et al. | 399/270 |
| 5,706,095 | A * | 1/1998 | Rathbun | 356/446 |
| 5,752,140 | A | 5/1998 | Danzuka et al. | 399/270 |
| 5,826,148 | A * | 10/1998 | Iino et al. | 399/240 |
| 6,029,036 | A | 2/2000 | Itaya et al. | 399/239 |
| 6,447,973 | B1 * | 9/2002 | Asami et al. | 430/114 |
| 6,459,862 | B1 | 10/2002 | Sakemi et al. | 399/55 |
| 6,546,222 | B2 | 4/2003 | Sakemi et al. | 399/276 |
| 2001/0021323 | A1 * | 9/2001 | Itaya et al. | 399/237 |
| 2002/0021918 | A1 * | 2/2002 | Yoshino | 399/237 |
| 2002/0076240 | A1 * | 6/2002 | Obu et al. | 399/237 |
| 2003/0049048 | A1 * | 3/2003 | Yoshikawa et al. | 399/129 |
| 2003/0072588 | A1 | 4/2003 | Sakemi et al. | 399/223 |

FOREIGN PATENT DOCUMENTS

| | | |
|---|---|---|
| JP | 7-209922 | 8/1995 |
| JP | 2001-356607 | 12/2001 |
| JP | 2002-311655 A * | 10/2002 |

* cited by examiner

*Primary Examiner*—Sophia S. Chen
(74) *Attorney, Agent, or Firm*—Fitzpatrick, Cella, Harper & Scinto

(57) ABSTRACT

A developing device for developing an electrostatic image formed on an image carrier, includes a liquid developing agent, wherein toner particles are dispersed in a liquid solvent, and wherein a viscosity of the liquid developing agent is in a range 100 mPa·s to 1000 mPa·s, inclusive, a developing container for containing the liquid developing agent, a developing agent carrier for carrying the liquid developing agent within the developing container to the image carrier, wherein the developing agent carrier is disposed so as to form a gap between the developing agent carrier and the image carrier; and a developing bias voltage power supply for applying a developing bias voltage, which superimposes a DC voltage component and an AC voltage component to the developing agent carrier, wherein a peak voltage of the AC voltage component is in a range of 0.5 kV to 2 kV, inclusive, and a frequency of the AC voltage component is in a range of 10 kHz to 12 kHz, inclusive.

5 Claims, 5 Drawing Sheets

DEVELOPING DEVICE FEATURING HIGH VISCOSITY DEVELOPING AGENT AND SUPERIMPOSED AC AND DC BIAS VOLTAGE COMPONENTS

BACKGROUND OF THE INVENTION

1. Field of the Invention

The present invention relates to a developing device for developing an electrostatic latent image formed on an image carrier with a liquid developing agent, which is employed in printers, photocopiers, facsimile devices, or the like.

2. Description of the Related Art

Conventionally, various types of image formation apparatuses have been proposed, wherein a thin film of a liquid developing agent is formed on the surface of a developing roller or a developing belt, serving as a developing agent carrier, following which the thin film of the developing agent is moved to a portion facing a photosensitive member serving as a latent-image carrier so as to be in contact with the photosensitive member, thereby forming a visible image from the electrostatic image formed on the photosensitive member. As a liquid developing agent employed in the aforementioned image formation apparatuses, an arrangement is known wherein toner (solid toner) is dispersed in a liquid solvent.

The aforementioned image formation apparatus may have a configuration wherein a film of a liquid developing agent is introduced between the photosensitive member and the developing agent carrier with a small gap so as to move the toner in the liquid developing agent to the photosensitive member. Accordingly, a visible image is formed from an electrostatic latent image on the photosensitive member, whereby an image (toner image) is formed with high resolution and excellent dot reproductivity.

FIG. 5A is a schematic diagram which shows the movement of the liquid developing agent at the time of developing. As shown in FIG. 5A, an electroconductive developing roller 13 having elasticity is employed as the developing agent carrier, and a thin film of the liquid developing agent is formed on the surface of the developing roller 13 using a blade. Furthermore, members such as spacing rollers or the like are provided at the ends of the developing roller 13 or a photosensitive drum 1 such that a small gap is formed at the developing portion D between the photosensitive drum 1 and the developing roller 13. The toner dispersed in the liquid developing agent forming a thin film on the developing portion D is adjusted so as to be charged with a predetermined magnitude. For example, the toner is charged positively in the example shown in FIG. 5A. The surface of the photosensitive drum 1 is uniformly and positively charged by charging means, following which the charges on the exposed portion (image portion) are removed by exposure means. Subsequently, a DC bias voltage serving as a developing bias voltage is applied with a potential greater than that of the exposed portion so that the developing agent is adhered to the exposed portion, whereby so-called inverse developing is performed.

However, such conventional developing devices employing the liquid developing agent have problems as follows.

In order to reduce the size of the entire developing device employing the liquid developing agent, the amount of waste liquid, as well as the amount of the liquid developing agent for developing, must be reduced. Accordingly, the liquid developing agent is preferably adjusted such that the concentration of the solid toner is increased, resulting in an increase of the viscosity of the liquid developing agent. That is to say, the liquid developing agent with high viscosity is required for such an apparatus. On the other hand, in a case of employing a volatile carrier liquid for the developing agent, there is a problem that air pollution might result from gasses emitted by the volatile carrier liquid. Taking such a problem into consideration, a nonvolatile carrier liquid is preferably employed. Accordingly, the carrier liquid is preferably adjusted to have high viscosity, and specifically, the viscosity thereof is preferably 100 mPa·s or more (see Japanese Patent Laid-Open No. 7-209922, and Japanese Patent Laid-Open No. 2001-356607).

As described above, from the point of reduction of the size of the apparatus, and environmental concerns, a liquid developing agent with high viscosity is preferably employed in the developing device. However, the developing device employing the developing agent with high viscosity has a problem that fogging can occur due to adhesion of the toner contained in the liquid developing agent to non-image portions, as with the portion E shown in FIG. 5B. Furthermore, the developing device employing the developing agent with high viscosity has another problem that a uniform thin film of the toner cannot be formed on the developing roller 13 due to the high viscosity of the carrier liquid, and accordingly, an image with a uniform density cannot be formed on a region where uniform exposure has been made.

As described above, the developing device having the conventional configuration wherein the liquid developing agent with high viscosity is employed from the point of reduction of the size thereof and environmental concerns, has the problem that fogging may occur due to adhesion of the toner onto non-image portions, and the problem that an image with a uniform density cannot be formed on a region where uniform exposure has been made.

SUMMARY OF THE INVENTION

It is an object of the present invention to provide a developing device for forming a toner image without deterioration such as fogging, irregularity in image density, and the like, even in the event of employing a liquid developing agent with high viscosity.

developing device for developing an electrostatic latent image formed on an image carrier comprises: a developing container for containing a liquid developing agent with viscosity of at least 100 mPa·s; and a developing agent carrier for carrying the liquid developing agent within the developing container to the image carrier; wherein a superimposed developing bias voltage, formed by a DC voltage component and an AC voltage component, is applied to the developing agent carrier. This arrangement serves to prevent deterioration of the image quality such as fogging, reduction of image density, and the like, due to the high viscosity of the developing agent.

Further objects, features and advantages of the present invention will become apparent from the following description of the preferred embodiments (with reference to the attached drawings).

DESCRIPTION OF THE PREFERRED EMBODIMENTS

Figure 1:
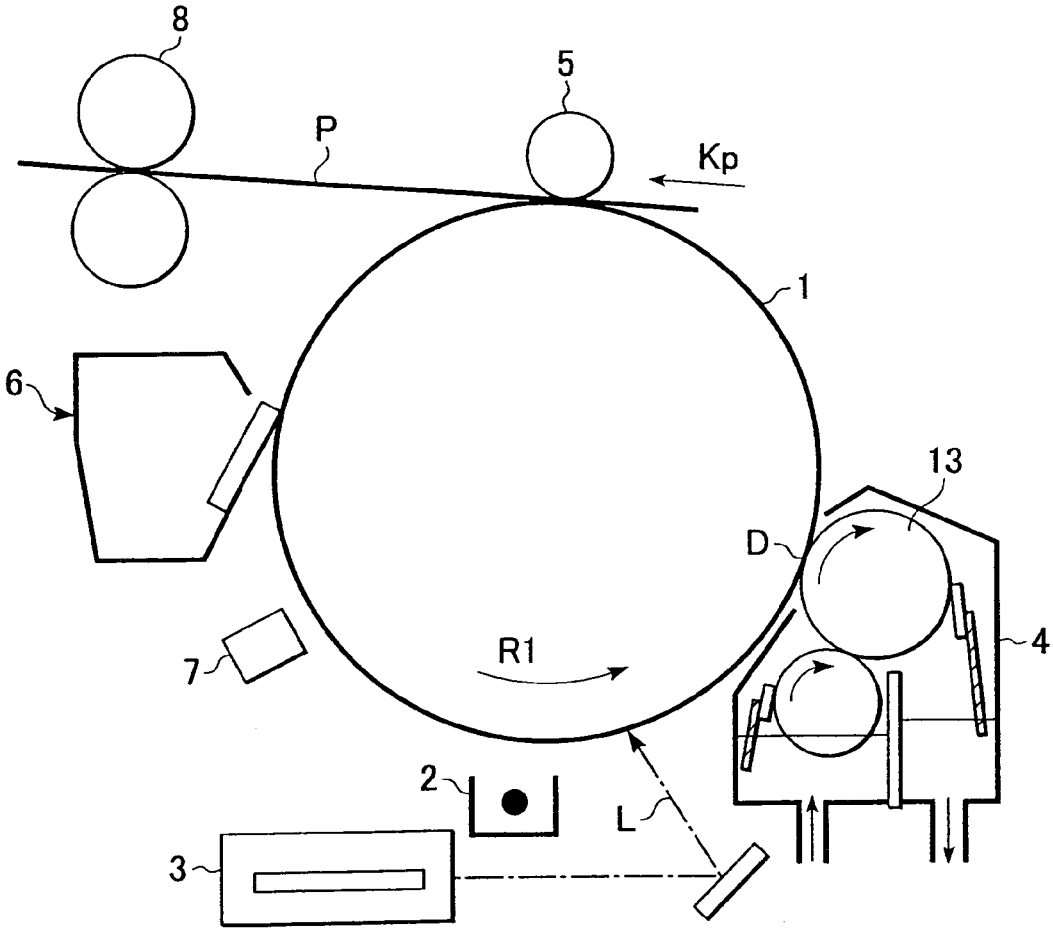
FIG. 1 is a longitudinal cross-sectional diagram which shows a schematic configuration of an image formation apparatus according to a first embodiment.

A description will be made regarding embodiments according to the present invention with reference to the drawings. Note that the components having the same configuration or performing the same operation are denoted by the same reference characters, and a redundant description thereof will be omitted.

First Embodiment

FIG. 1 shows an image formation apparatus according to a first embodiment as an example of an image formation apparatus according to the present invention. The image formation apparatus shown in the drawing is an electrophotographic image formation apparatus (e.g., a printer, photocopier, or facsimile device) which performs developing using a liquid developing agent. FIG. 1 is a longitudinal cross-sectional diagram (cross-sectional diagram in the direction orthogonal to the axis serving as the center of rotation of a photosensitive drum) which shows a schematic configuration including principal components.

The image formation apparatus shown in the drawing includes a rotational drum electrophotographic photosensitive member (which will be referred to as "photosensitive drum" hereafter) 1 serving as an image carrier. The image formation apparatus further includes a charger (charging means) 2, an exposure device (exposure means) 3, a liquid developing device (developing means) 4, a transfer roller (transfer means) 5, a cleaning device (cleaning means) 6, a pre-exposure device 7, around the photosensitive drum 1, generally in that order, along the rotational direction of the photosensitive drum 1 (in the direction of the arrow R1). Furthermore, the image formation apparatus includes a fixing device 8 along the transport direction (in the direction of the arrow Kp) for a recording member P (e.g., paper sheet or transparent film) downward from the transfer roller 5.

With the image formation apparatus having the above-described configuration, the photosensitive drum 1 is rotationally driven by driving means (not shown) in the direction of the arrow R1 at a constant process speed (circumferential speed), and the surface thereof is uniformly charged with a predetermined polarity and potential by the charger 2. Subsequently, exposure L is performed for the charged surface of the photosensitive drum 1 corresponding to the image information by the exposure device 3. Accordingly, the charges are removed from the exposed portions, thereby forming an electrostatic latent image. Solid toner (which will be simply referred to as "toner" hereafter) is adhered to the electrostatic latent image at the developing portion (developing position) D by the liquid developing device 4, whereby a toner image is formed. Note that a detailed description will be made later regarding the liquid developing device 4.

The toner image formed on the photosensitive drum 1 described above is transferred onto the recording member P supplied to the transfer portion between the photosensitive drum 1 and the transfer roller 5 by a feeding means (not shown). The transfer toner residue is removed from the surface of the photosensitive drum 1 by a cleaning blade 62*a* of the cleaning device 6 after transfer of the toner image. The surface of the photosensitive drum 1, wherein the transfer toner residue has been removed, is discharged by the pre-exposure device 7, whereby a next image formation can be made on the photosensitive drum 1. On the other hand, the recording member P onto which the toner image has been transferred is transported to the fixing device 8, and is heated and pressed, so that the toner image is fixed on the surface thereof. The recording member P onto which the toner image has been fixed is discharged outside a main unit (not shown) of the image formation apparatus, whereby a single-color image formation is completed for the one recording member P.

Figure 2:
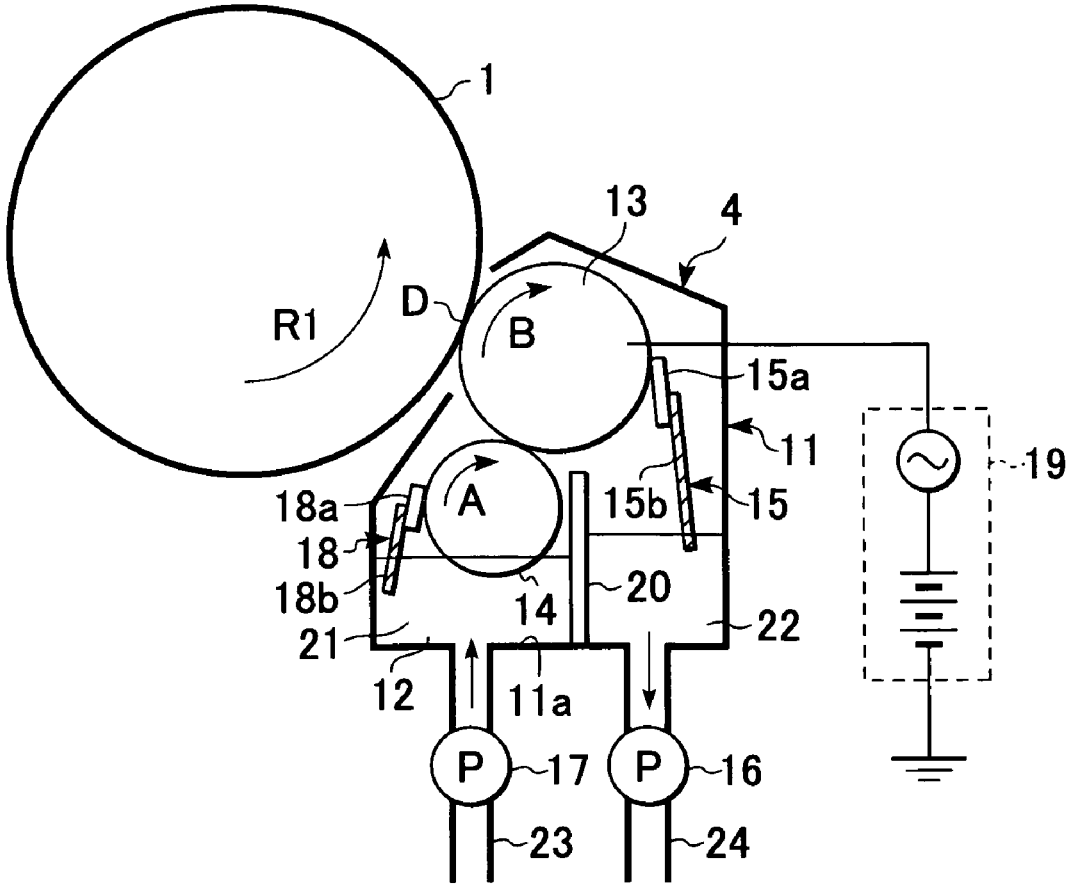
FIG. 2 is a longitudinal cross-sectional diagram which shows a schematic configuration of a liquid developing device according to the first embodiment.

FIG. 2 is an enlarged view of the liquid developing device 4 shown in FIG. 1. As shown in the drawing, the liquid developing device 4 includes a developing container 11 for storing a liquid developing agent 12. The image formation apparatus includes the developing roller 13 serving as a developing agent carrier, a coating roller 14 for coating the developing roller 13 with the liquid developing agent 12, a restricting member 18 for restricting the amount of the liquid developing agent 12 on the coating roller 14, and a cleaning member 15 for removing the liquid developing agent 12 on the developing roller 13, within the developing container 11.

The aforementioned developing container 4 is disposed diagonally downward from the photosensitive drum 1. The inside of the developing container 4 is partitioned into a first storage chamber 21 and a second storage chamber 22 with a partition 20 erected on the bottom 11*a*. The first storage chamber 21 is provided for storing the liquid developing agent 12 which has not been used for developing, and on the other hand, the second storage chamber 22 is provided for storing the liquid developing agent 12 which has been used for developing. The first storage chamber 21 includes a supply path 23 connected to the bottom thereof for supplying the liquid developing agent 12 to the storage chamber 21, and a pump 17 is disposed at a predetermined portion on the supply path 23. On the other hand, the second storage chamber 22 includes a discharge path 24 connected to the bottom thereof for discharging the liquid developing agent 12 from the storage chamber 22, and a pump 16 is disposed at a predetermined portion on the discharge path 24.

The liquid developing agent 12 is a solution wherein a low-volatility carrier solvent formed of an insulating liquid such as dimethylpolysiloxane oil or the like contains toner dispersed therein with a high concentration, for example. Furthermore, the liquid developing agent 12 is adjusted so as to exhibit high viscosity R in a range of 100 to 1000 mPa·s, inclusive.

The developing roller 13 is disposed parallel with the photosensitive drum 1, and is supported by the developing container 11 so as to be rotated in the direction of the arrow B. The rotational (movement) direction of the circumference of the developing roller 13 is the so-called forward direction as to the rotational (movement) direction of the circumference of the photosensitive drum 1. The developing roller 13 includes ring-shaped spacer rings (not shown) at both ends thereof in the longitudinal direction. The spacer rings are pressed into contact with regions on the circumference of the photosensitive drum 1 which do not serve to carry images, thereby maintaining a small gap between the developing roller 13 and the photosensitive drum 1. The small gap formed as described above serves as the developing portion D. The image formation apparatus according to the present embodiment has a configuration wherein the developing portion D is positioned diagonally downward from the photosensitive drum 1.

The coating roller 14 is pressed into contact with the developing roller 13 from generally directly below. The coating roller 14 is disposed such that the lower portion thereof is dipped in the liquid developing agent 12 stored in the aforementioned first storage chamber 21, and such that the circumference thereof is rotated in the reverse direction (the direction of the arrow A) as to the rotational direction (the direction of the arrow B) of the circumference of the developing roller 13.

The restriction member 18 includes a restriction blade 18*a* pressed into contact with the circumference of the coating roller 14, and a support member 18*b* for pressing the restriction blade 18*a* into contact with the circumference of the coating roller 14. The restriction blade 18*a* is pressed into contact with the coating roller 14 in the forward direction as to the rotational direction thereof.

The cleaning member 15 includes a cleaning blade 15*a* pressed into contact with the circumference of the developing roller 13, and a support member 15*b* for pressing the cleaning blade 15*a* into contact with the circumference of the developing roller 13. The cleaning blade 15*a* is pressed into contact with the developing roller 13 so as to face the rotational direction thereof.

With the liquid developing device 4 having the above-described configuration, the liquid developing agent 12 which has been used for developing is scraped off from the surface of the developing roller 13 by the cleaning blade 15*a* of the cleaning member 15, and is stored in the second storage chamber 22. The stored liquid developing agent 12 is discharged by the pump 16 through the discharge path 24, and is temporarily stored in a developing-agent-concentration-adjustment tank (not shown). The concentration of the stored liquid developing agent 12 is adjusted within a predetermined range in the developing-agent-concentration-adjustment tank, following which the liquid developing agent 12 is supplied to the first storage chamber 21 by the pump 17 through the supply path 23, and is stored therein.

The coating roller 14 is dipped in the liquid developing agent 12 stored in the first storage chamber 21 as described above, at the lower portion thereof, while rotating in the direction of the arrow A. The liquid developing agent 12 transferred onto the coating roller 14 is spread on the surface of the coating roller 14 by the restricting blade 18*a* of the restricting member 18, whereby a uniform thin film of the liquid developing agent 12 is formed on the coating roller 14. Subsequently, the liquid developing agent 12 forming a thin film on the surface of the coating roller 14 is spread on the surface of the developing roller 13 rotating in the direction of the arrow B, whereby the developing roller 13 is coated with a uniform thin film of the liquid developing agent 12. Subsequently, the liquid developing agent 12 forming a uniform thin film on the surface of the developing roller 13 is transported to the developing portion D by rotation of the developing roller 13 in the direction of the arrow B. At the developing portion D, the toner in the liquid developing agent on the developing roller 13 adheres to an electrostatic latent image on the photosensitive drum 1, thereby forming a toner image from the electrostatic latent image. The liquid developing agent 12 which has been used for developing is scraped off from the developing roller 13 by the cleaning member 15, and is stored in the second storage chamber 22, as described above.

With the above-described liquid developing device 4, a developing bias voltage is applied to the developing roller 13 by a developing bias voltage applying power supply 19 at the time of developing. With the liquid developing device 4 according to the present embodiment, a superimposed bias voltage, wherein a DC bias voltage component and a high-frequency AC bias voltage component in the form of a sine-wave voltage with a frequency of 8 kHz have been superimposed, is applied to the developing roller 13 as the developing bias voltage. Note that the peak value of the AC bias voltage should be determined based upon the resistance of the developing roller 13, and the distance of the small gap serving as the developing portion D between the developing roller 13 and the photosensitive drum 1. In general, the peak value of the AC bias is preferably in a range of 0.5 kV to 2 kV, inclusive.

A description will now be made below regarding the behavior of the liquid developing agent 12 supplied to the developing portion D with reference to FIG. 3. Note that the reference character D denotes the developing portion which is a small gap between the surface of the photosensitive drum 1 and the surface of the developing roller 13, 12 denotes the liquid developing agent, 12*a* denotes a carrier liquid forming the liquid developing agent 12, and 12*b* denotes the toner contained in the liquid developing agent 12.

With the image formation apparatus employing the liquid developing agent 12 having high viscosity, in the event that only a DC bias is applied as the developing bias voltage at the time of developing in the same way as with the conventional image formation apparatus, the toner 12*b* contained in the developing agent 12 moves within the carrier liquid 12*a* due to a developing electric field formed on the developing portion D. However, the toner 12*b* requires a long time to move due to the high viscosity of the liquid developing agent 12. Accordingly, a problem occurs that a toner image may not be formed on image portions with a sufficient density, and a problem occurs that the liquid developing agent 12 may not be sufficiently removed from non-image portions, leading to a difficulty in obtaining a uniform toner image without fogging.

Figure 3:
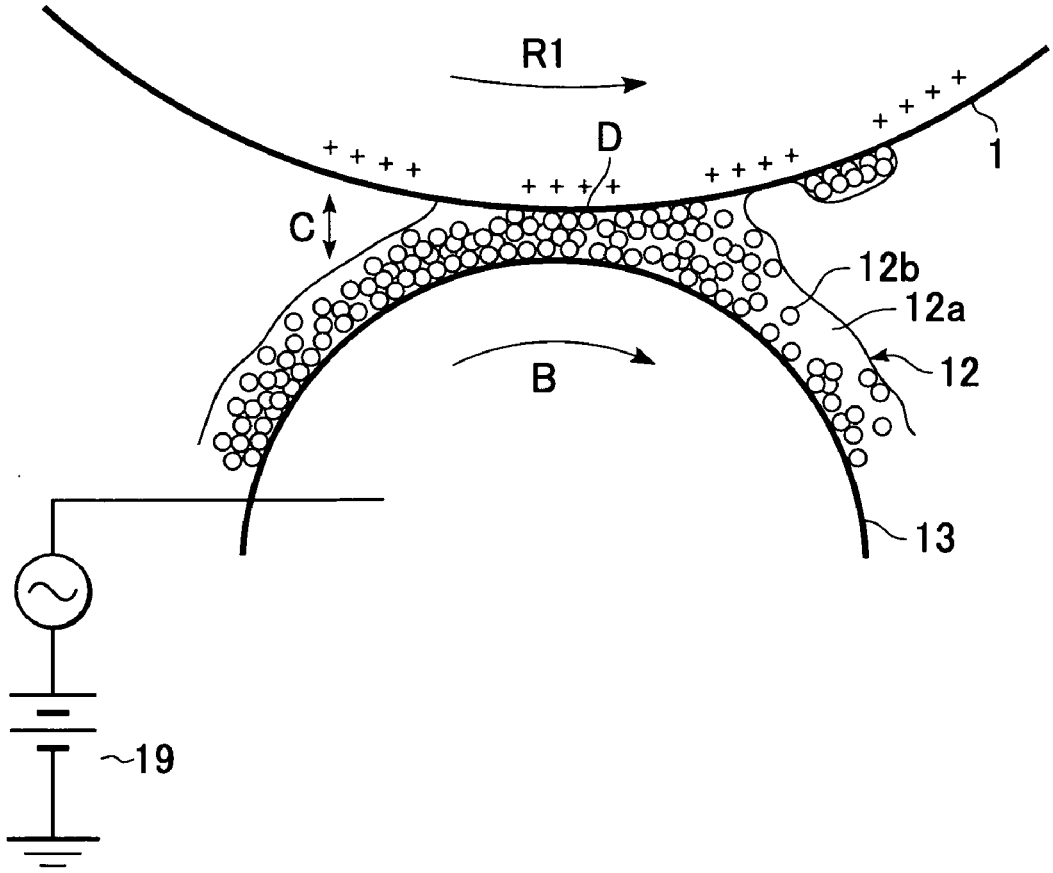
FIG. 3 is a diagram for describing movement of a liquid developing agent 12, and carrier liquid 12*a* and toner 12*b* forming the developing agent 12, at a developing portion.

Accordingly, with the present embodiment, a superimposed bias voltage, wherein a DC bias voltage component and a high-frequency AC bias voltage component with the frequency of 8 kHz have been superimposed, is applied to the developing roller 13 as the developing bias voltage, and accordingly, the toner 12*b* contained in the liquid developing agent 12 is vibrated in the developing portion D with a small amplitude in the directions shown by the arrow C shown in the drawing (vibrating reciprocally generally orthogonal to the tangent line passing through the developing portion D, projected onto the developing roller 13 and the photosensitive drum 1, i.e., generally in the vertical direction in FIG. 3) due to the AC bias voltage component. At the same time, the liquid developing agent 12 is smoothly moved from the surface of the developing roller 13 onto the surface of the image portions on the surface of the photosensitive drum 1, and from the non-image portions on the surface of the photosensitive drum 1 to the surface of the developing roller 13, due to the electric field formed by the DC bias voltage. That is to say, it is thought that the toner 12*b* readily moves in the liquid developing agent 12 (carrier liquid 12*a*), even though the viscosity is high, due to the assistance of the electric field formed of the high-frequency AC bias voltage with the frequency of 8 kHz, and thus, the toner is smoothly moved corresponding to the electric field formed by the DC bias voltage.

While a description has been made regarding the image formation apparatus according to the present embodiment wherein the AC bias voltage with the high frequency of 8 kHz is employed, an arrangement may be made wherein the AC bias voltage with a high frequency of 5 kHz or more is employed for exhibiting generally the same advantages. Note that in a case of employing the AC bias voltage with a frequency of 5 kHz or less, the toner 12*b* moves too much under small-amplitude vibration (along the length of the arrow C shown in FIG. 3), and accordingly, a problem occurs that the toner 12*b* might move onto the non-image portions on the surface of the photosensitive drum 1, resulting in a problem of fogging. On the other hand, in a case of employing the AC bias voltage with a frequency of 12 kHz or more, the toner 12*b* moves with too little a distance under small-amplitude vibration, leading to a problem of irregularity in the image density. Accordingly, the frequency of the AC bias voltage is determined in a range of 5 kHz to 12 kHz, inclusive. Furthermore, the frequency of the AC bias voltage is preferably in a range of 10 kHz to 12 kHz, inclusive, and from the point of the above-described advantages.

Thus, the image formation apparatus according to the present embodiment has a configuration wherein a superimposed developing voltage including a high-frequency AC bias voltage is applied to the developing roller 13, thereby providing a uniform toner image without fogging in a sure manner, even in a case of employing the liquid developing agent 12 with a viscosity μ of 100 mPa·s or more.

Second Embodiment

Figure 4:
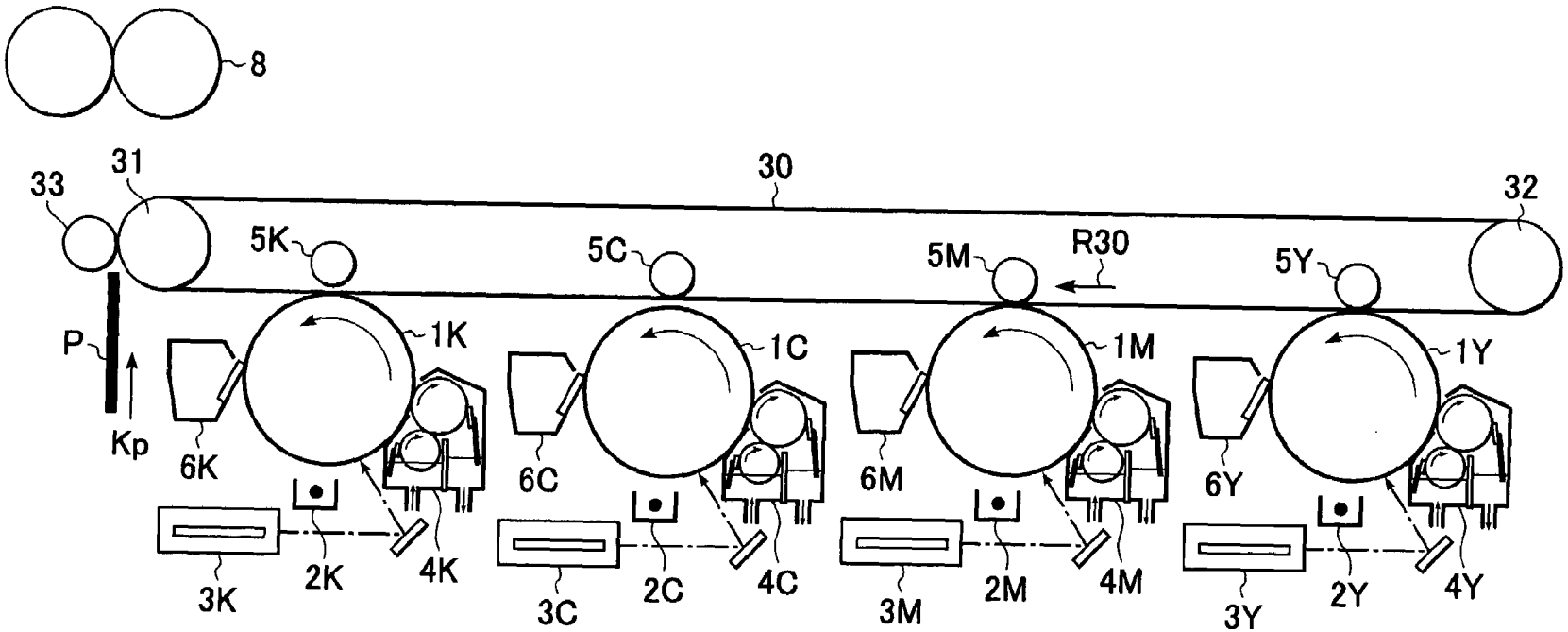
FIG. 4 is a longitudinal cross-sectional diagram which shows a schematic configuration of an image formation apparatus according to a second embodiment.
Figure 5A:
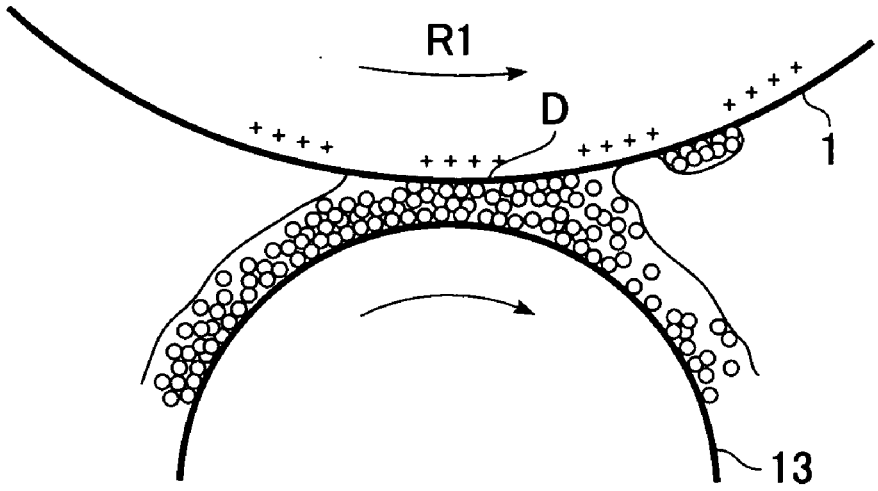
FIG. 5A is a diagram for describing the way in which the toner carried on the surface of a developing roller adheres to an electrostatic latent image on a photosensitive drum in a case of employing the liquid developing agent with a high toner concentration.
Figure 5B:
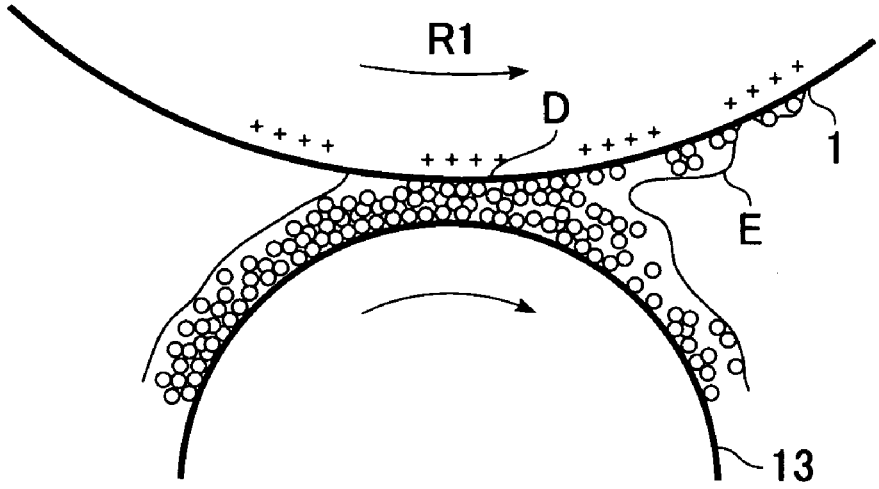
FIG. 5B is a diagram for describing a scene of a part of the toner in the liquid developing agent being adhered to non-image portions due to high viscosity of the liquid developing agent, leading to a problem of fogging.

FIG. 4 is a schematic diagram which shows a configuration of an image formation apparatus according to a second embodiment. FIG. 4 shows an arrangement wherein the developing device according to the present invention is applied to a full-color image formation apparatus using four colors, employing an intermediate transfer member.

First, a description will be made regarding the schematic configuration and operation of the image formation apparatus with reference to FIG. 4. Note that the reference character Y denotes yellow, M denotes magenta, C denotes cyan, and K denotes black.

Photosensitive drums 1Y, 1M, 1C, and 1K, serving as image carriers, are rotationally driven in the direction of the respective arrows (in the counterclockwise direction in the drawing), and the surfaces thereof are uniformly charged with a predetermined polarity and potential by primary chargers 2Y, 2M, 2C, and 2K, respectively. Subsequently, exposure is performed for the charged surfaces of the photosensitive drums 1Y, 1M, 1C, and 1K, by exposure devices 3Y, 3M, 3C, and 3K, based upon the image information, thereby forming electrostatic latent images on the surfaces of the photosensitive drums 1Y, 1M, 1C, and 1K. Subsequently, toner is adhered onto these electrostatic latent images by liquid developing devices 4Y, 4M, 4C, and 4K, thereby forming toner images. Note that the configuration and operation of the liquid developing devices 4Y, 4M, 4C, and 4K, are the same as with the liquid developing device 4 in FIG. 2 described above in the above first embodiment, so a description thereof will be omitted. Note that the toners stored in the liquid developing devices 4Y, 4M, 4C, and 4K, are used for forming images in yellow, magenta, cyan, and black, respectively.

An intermediate transfer belt 30 (intermediate transfer member) 30 strung over a driving roller 31 and a slave roller 32 is disposed above the photosensitive drums 1Y, 1M, 1C, and 1K. The intermediate transfer belt 30 is rotationally driven in the direction of the arrow R30 by rotation of the driving roller 31 in the clockwise direction in FIG. 4. The intermediate transfer belt 30 is pressed into contact with the photosensitive drums 1Y, 1M, 1C, and 1K, by primary transfer rollers 5Y, 5M, 5C, and 5K, disposed on the rear side of the intermediate transfer belt 30, thereby forming primary transfer portions between the intermediate transfer belt 30 and the photosensitive drums 1Y, 1M, 1C, and 1K.

The toner images of the respective colors formed on the aforementioned photosensitive drums 1Y, 1M, 1C, and 1K, are transferred to the intermediate transfer belt 30 in order, at corresponding primary transfer portions by the primary transfer roller 5Y, 5M, 5C, and 5K, whereby four toner images are superimposed on the intermediate transfer belt 30.

The four color toner images superimposed on the intermediate transfer belt 30 are transferred onto the recording member P supplied from the direction of the arrow Kp at the same time at a secondary transfer portion formed between the intermediate transfer belt 30 and a secondary transfer belt 33. The recording member P, onto which the four color toner images have been transferred, is heated and pressed by the fixing device 8, whereby the four toner images are fixed on the surface of the recording member P. Thus, full-color image formation using four colors is completed. Note that the toner residue (transfer toner residue) on the photosensitive drums 1Y, 1M, 1C, and 1K, is removed by cleaning devices 6Y, 6M, 6C, and 6K, following primary transfer of the toner image.

With the image formation apparatus according to the present embodiment, the intermediate transfer belt 30 serving as an intermediate transfer member is disposed above the photosensitive drums 1Y, 1M, 1C, and 1K, and the liquid developing devices 4Y, 4M, 4C, and 4K, are disposed diagonally downward from the photosensitive drums 1Y, 1M, 1C, and 1K.

The image formation apparatus for performing developing using a liquid developing agent preferably has a configuration wherein components for cycling the liquid developing agent with high viscosity are provided below developing containers within the developing devices so as to cycle the liquid developing agent downward from the developing containers, giving consideration to the operation wherein the liquid developing agent is scraped off from the developing roller by the cleaning member (see FIG. 2). Accordingly, at least the upper ends of the liquid developing devices 4Y, 4M, 4C, and 4K, should be positioned downward from the upper ends of the photosensitive drums 1Y, 1M, 1C, and 1K. With the image formation apparatus having a configuration wherein the liquid developing devices 4Y, 4M, 4C, and 4K, are disposed at such positions, the components within the liquid developing devices 4Y, 4M, 4C, and 4K, for cycling the liquid developing agent are positioned downward from the lower ends of the photosensitive drums 1Y, 1M, 1C, and 1K. Furthermore, the intermediate transfer belt 30 is disposed above the photosensitive drums 1Y, 1M, 1C, and 1K, as shown in FIG. 4, and thus, the present invention provides an small-sized image formation apparatus having a simple configuration for cycling the liquid developing agent.

While a description has been made in the above embodiments with reference to examples wherein the image formation apparatuses is configured such that high-frequency sine-wave AC voltage is employed for the AC bias voltage component included in the developing bias voltage, as an example, the waveform of the AC voltage for the developing bias voltage is not restricted to any particular one, and a square-wave AC voltage component may be employed, for example. The image formation apparatus employing the square-wave AC voltage component for the developing bias voltage exhibits improved response of movement of the toner in the liquid developing agent, thereby providing a uniform toner image with higher resolution without fogging. Note that an arrangement may be made wherein another type of AC voltage with a high frequency is employed for the developing bias voltage, instead of the sine-wave AC voltage and the square-wave AC voltage.

As described above, with the image formation apparatus including the liquid developing device having such a configuration described in the above embodiments, wherein a developing bias voltage is applied to a developing agent carrier for supporting and transporting a liquid developing agent, and the liquid developing agent with a viscosity of 100 to 1000 mPa·s is employed for forming a toner image, a voltage wherein a DC voltage and an AC voltage has been superimposed is employed for the aforementioned developing bias voltage, and specifically, a high-frequency AC voltage with a frequency in a range of 5 kHz to 12 kHz, inclusive, is employed for the aforementioned AC voltage, thereby efficiently preventing the problems of fogging, irregularity in image density, and the like, due to high viscosity of the liquid developing agent.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A developing device for developing an electrostatic image formed on an image carrier, said developing device comprising:

a liquid developing agent, wherein toner particles are dispersed in a liquid solvent, and wherein a viscosity of the liquid developing agent is in a range 100 mPa·s to 1000 mPa·s, inclusive;

a developing container for containing said liquid developing agent;

a developing agent carrier for carrying the liquid developing agent within said developing container to the image carrier, wherein said developing agent carrier is disposed so as to form a gap between said developing agent carrier and said image carrier; and a developing bias voltage power supply for applying a developing bias voltage, which superimposes a DC voltage component and an AC voltage component to the developing agent carrier, wherein a peak voltage of the AC voltage component is in a range of 0.5 kV to 2 kV, inclusive, and a frequency of the AC voltage component is in a range of 10 kHz to 12 kHz, inclusive.

2. A developing device according to claim 1, further comprising:

a supplying roller for supplying said liquid developing agent in said developing container; and a restriction member for restricting an amount of said liquid developing agent carried on said supplying roller.

3. A developing device according to claim 1, wherein the AC voltage component has a substantially square-wave waveform.

4. A developing device according to claim 1, wherein the AC voltage component has a substantially sine-wave waveform.

5. A developing device according to claim 1, wherein said supplying roller rotates in the same direction as the rotation of said developing agent carrier.

* * * * *